United States Patent [19]

Nestroy

[11] 3,998,025

[45] Dec. 21, 1976

[54] COMBINATION LIGHT FIXTURE AND POST STRUCTURE

[76] Inventor: Joseph F. Nestroy, 4523 Knoxville Ave., Lakewood, Calif. 90713

[22] Filed: Jan. 2, 1973

[21] Appl. No.: 320,436

[52] U.S. Cl. ..... 52/632; 52/28; 52/122; 52/127; 52/301

[51] Int. Cl.[2] ..... E04G 25/04; E04G 12/18

[58] Field of Search ..... 52/632, 84, 122, 243, 52/127, 301, 28; 248/354, 354 S

[56] References Cited

UNITED STATES PATENTS

| | | | |
|---|---|---|---|
| 2,311,951 | 2/1943 | Marshall | 52/243 |
| 3,170,545 | 2/1965 | Toti et al. | 52/301 X |
| 3,245,181 | 4/1966 | Stephenson | 52/122 |
| 3,280,527 | 10/1966 | Faust | 52/632 X |
| 3,333,808 | 8/1967 | DuBoff | 248/354 R |
| 3,378,978 | 4/1968 | Durand | 52/632 |

FOREIGN PATENTS OR APPLICATIONS

| | | | |
|---|---|---|---|
| 1,263,311 | 5/1961 | France | 52/637 |

*Primary Examiner*—Alfred C. Perham
*Attorney, Agent, or Firm*—John J. Kowalik

[57] ABSTRACT

A light post which serves as a structural member and has upper and lower adjustable connections comprising end caps which are securable to a base and supported structure, respectively, and between which the post extends and telescopes at its ends into the caps. The post is provided with axially extruding bolts which thread through respective end portion of the post and are extensible and retractable endwise to position the post and also lock a cover panel in closed position and in which parts are temporarily distortable to facilitate securing and release thereof.

4 Claims, 5 Drawing Figures

COMBINATION LIGHT FIXTURE AND POST STRUCTURE

DISCUSSION OF THE PRIOR ART

Decorative posts have heretofore afforded a structure which was relatively difficult to install and which did not allow much flexibility in adjusting to actual building conditions, wherein the structures normally deviate from the precise dimensions set out in building plans due to settling of the base and/or minor variations in the workmanship of the craftsmen. Various types of baseboards and trim strips are used as well as shims for taking up excess dimensions. If the space is less than the length of the column or post, the post must be cut or the structures notched, which frequently adversely affects the aesthetics.

SUMMARY OF THE INVENTION

This invention is directed to a novel post structure which is adjustable lengthwise and in which parts telescope to provide interlocking relationships with each other.

Another object is to provide a novel lighted post structure of ornamental design and in which the post comprises a center column portion which is shiftable vertically to adjusted as well as locking positions.

A further object is to provide a novel post structure comprising a center column portion which fits into end caps at its upper and lower ends and the post being provided with adjustable assemblies for tightening the same against the end caps or loosening the same for release.

These and other objects and advantages whereat in and encompassed by the invention will become more readily apparent from the specifications and the drawings, wherein.

DESCRIPTION OF THE INVENTION

Figure 1:
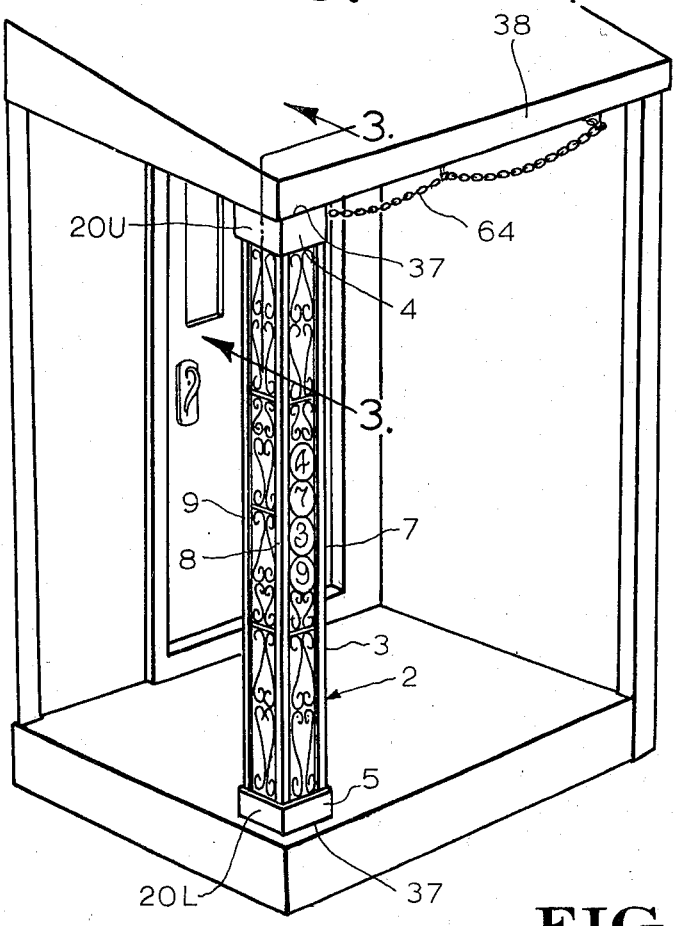
FIG. 1 is a perspective view of my novel post assembly shown in association with a typical building structure.

The post assembly generally designated 2 comprises a center column portion 3 and upper and lower end caps 4 and 5.

The central portion 3 is shown as a quadrilateral preferably square structure in cross-section, although the invention is applicable to any shape. In the preferred construction the central post section 3 has flexible peripheral angle iron corner members 6,7,8 and 9 which are joined at their upper and lower ends by cross-braces of x-shaped bracket elements, 10,10.

Each bracket 10 comprises an upper strap and a lower strap 12; the upper strap 11 extends between corner members 6,8 and at its ends is welded thereto, and the lower strap 12 extends between the corner members 7,9 and at its ends is weld-connected thereto. The straps 11,12 are overlapped at their center portions and weld-connected to each other to form a thick pad 15 which has a threaded opening 16 through which a threaded shank 17 of a securing and adjusting bolt 18 is threaded.

The bolt 18 has a polygonal head 19 for wrench-engagement and is adapted to be turned to advance and retract the shank with respect to the related bracket.

The upper and lower ends of the post center section are encased by end caps 20 U and 20 L, each of which is in the nature of a square container having four vertical side walls 21,22,23 and 24 which respectively parallel and slide along the sides 25,26,27 and 28 of the complementally shaped end section of the post in a close fitting relationship thereto. Each end cap also has a horizontal end wall 30 which is joined to the common edges of the side walls and provides an abutment surface 32 for the free end 33 of the adjusting bolt 18, which extends axially of the post. It will be readily apparent that for retraction of an end portion of the center section of the post with respect to its associated end cap, axial loading is applied by the bolts between the end caps and the post center section tending to spread the end caps apart. This novel arrangement of the parts and construction thereof cause the brackets to bow away from the end walls 30 of the respective end caps, whereby the skeletal corner portion of the post are caused to slightly bend inwardly toward the axis of the center section whereby the parts are loosened and will readily separate even after extensive weathering without the necessity of lubrication, etc., although lubrication would be preferred.

Once these pieces are separated it is relatively easy to properly lubricate them and slide them into fitting or separating relation.

It will be noted that the identical end cap assemblies are used at the upper and lower end portions 35 and 36. It will be seen that the outer side 37 of the end wall of the upper end cap is adapted to seat against the underside of a canopy, roof overhang or other supported structure 38 and secured thereto as by screws 39,39.

In addition to the bolts 18 being used to release the end sections of the post from the end caps, these bolts by properly threading and unthreading tighten the post between the supporting and supported structure, and also are useful to adjust the center section axially up and down so as to enter the upper or lower ends of the center section lesser or greater amounts into the respective end cap.

Figure 2:
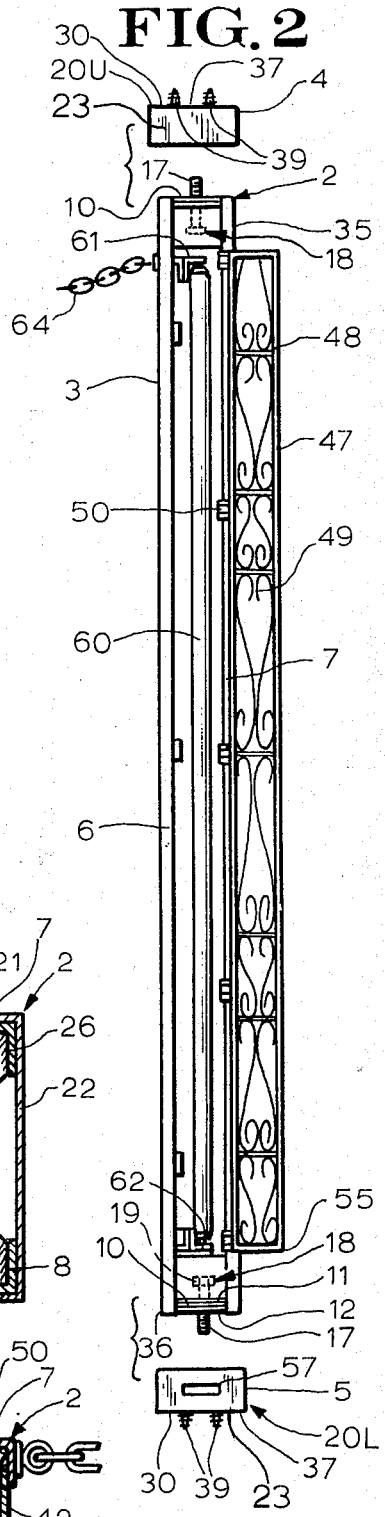
FIG. 2 is an exploded enlarged side elevational view of the post assembly.
Figure 3:
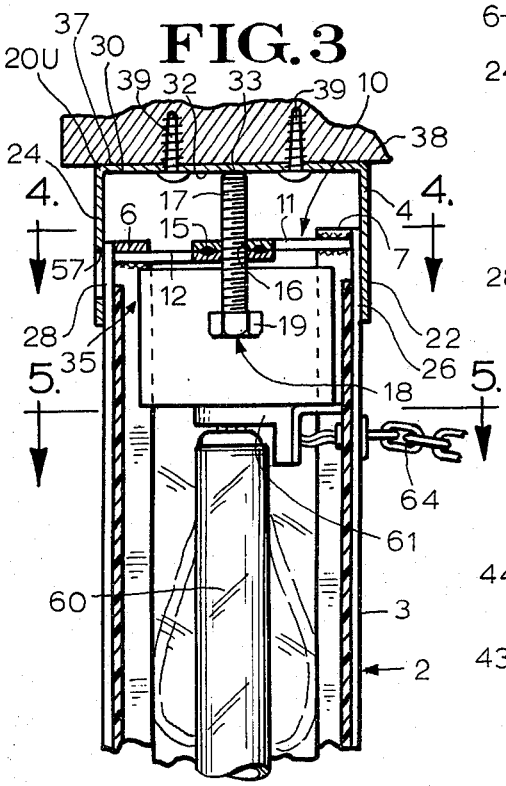
FIG. 3 is an enlarged fragmentary sectional post assembly taken substantially on line 3—3 of FIG. 1.
Figure 4:
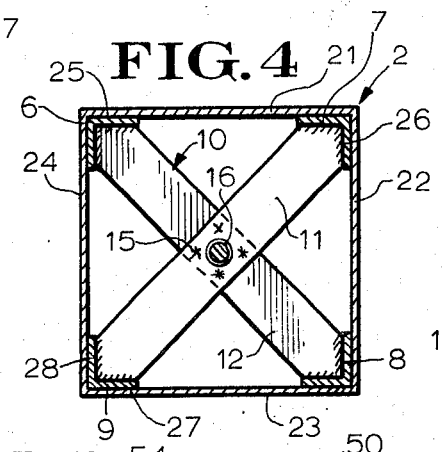
FIG. 4 is a cross-sectional view on line 4—4 of FIG. 3.
Figure 5:
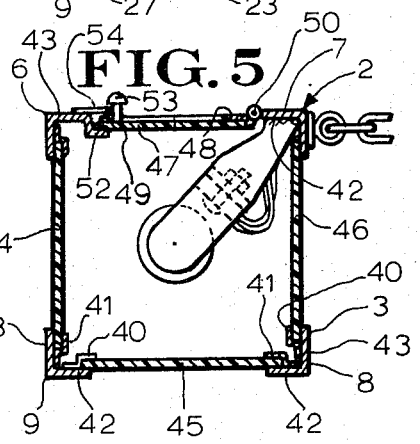
FIG. 5 is a cross-sectional view taken on line 5—5 of FIG. 3.

As best seen in FIGS. 2 and 5 the corner elements are provided with clips 40,41 on the interiors of their flanges 42,43 which grasp and releasably hold ornamental translucent panels of glass or plastic 44,45,46. An access door 47 is provided and it extends the full length of the post and has a frame 48 about a translucent panel 49. The frame 48 is mounted along one vertical edge by means of vertical hinges 50 to one flange 42 of corner element 7 and at its opposite edge abuts a stop 52 on the flange 43 of the corner member 6 of the post to prevent the door from swinging inwardly. A snap latch 53 is provided on the door frame which engages with a catch 54 on the corner element 9.

In certain areas where vandalism may be rampant, the invention provides another feature in that the door 47 is adapted to be shifted vertically with the post to telescope preferably at its lower edge 55 into the lower cap so that the door cannot be opened. This is accomplished by entering a wrench through the access opening 57 in one of the side walls of each end cap and unscrewing the lower bolt and tightening the upper bolt. Thus, the door cannot be opened unless the upper bolt is loosened and the lower bolt screwed down. The securement of the door prevents unauthorized removal of the florescent light bulb 60 which is mounted vertically into upper and lower sockets 61 and 62 suitably wired by cord and aesthetic chain assembly 64 to a source of house current.

What is claimed is:

1. A post assembly for supporting a supported structure from a supporting structure, comprising telescoping close fitting inner and outer sections, and means for relatively deflecting at least one of said sections transaxially to contract and expland said sections relative to each other to accommodate axial adjusting movements therebetween and to lock the same to each other and said other of said sections comprising end caps sleeved over the inner of said sections, and said inner section comprising a skeletal peripheral end portion, and said means comprising a transaxial bracket connected to said end portion of said inner section, and said means deflecting said bracket axially of said inner section to thereby deflect said peripheral portion transaxially out of binding engagement with the related end cap.

2. A post assembly for supporting a supported structure from a supporting structure, comprising telescoping close fitting inner and outer sections, and means for relatively deflecting at least one of said sections transaxially to contract and expand said sections relative to each other to accommodate axial adjusting movements therebetween and to lock the same to each other and said inner of said sections comprising a plurality of elements defining a peripheral end portion, and a bracket within said end portion comprising flexible means interconnecting opposed elements of said end portion, and means for deflecting said flexible means axially of the post, and thus deflecting said elements transversely of the post into and out of locking engagement with the associated outer of said sections.

3. The invention according to claim 2 and said means for deflecting said flexible means axially comprising a bolt threaded through said flexible interconnecting means and abutting a portion of the adjacent outer member for compressive loading thereagainst.

4. The invention according to claim 3 and said flexible means comprising straps.

* * * * *